United States Patent [19]

Henning et al.

[11] Patent Number: 5,044,341

[45] Date of Patent: Sep. 3, 1991

[54] PROCESS AND DEVICE FOR TANK-VENTILATION ADAPTATION IN LAMBDA CONTROL

[75] Inventors: Cordes Henning, Eberdingen; Kurle Jürgen, Reutlingen; Pfau M. Eberhard, Weissach, all of Fed. Rep. of Germany

[73] Assignee: Robert Bosch GmbH, Stuttgart, Fed. Rep. of Germany

[21] Appl. No.: 473,941

[22] PCT Filed: Jun. 8, 1989

[86] PCT No.: PCT/DE89/00379

§ 371 Date: Mar. 1, 1990

§ 102(e) Date: Mar. 1, 1990

[87] PCT Pub. No.: WO90/00225

PCT Pub. Date: Jan. 11, 1990

[30] Foreign Application Priority Data

Jul. 1, 1988 [DE] Fed. Rep. of Germany ..... 3822300

[51] Int. Cl.[5] ..... F02M 25/08; F02D 41/26

[52] U.S. Cl. ..... 123/489; 123/520

[58] Field of Search ..... 123/440, 489, 520

[56] References Cited

U.S. PATENT DOCUMENTS

| | | | |
|---|---|---|---|
| 4,013,054 | 3/1977 | Balsley et al. | 123/519 |
| 4,275,697 | 7/1981 | Stoltman | 123/520 |
| 4,461,258 | 7/1984 | Becker et al. | 123/489 |
| 4,467,769 | 8/1984 | Matsumura | 123/489 |
| 4,646,702 | 3/1987 | Matsubara et al. | 123/489 |
| 4,683,861 | 8/1987 | Breitkreuz et al. | 123/520 |
| 4,763,634 | 8/1988 | Morozumi | 123/520 |
| 4,821,701 | 4/1989 | Nanke, II et al. | 123/489 |
| 4,831,992 | 5/1989 | Jundt et al. | 123/520 |
| 4,926,825 | 5/1990 | Ohtaka et al. | 123/520 |
| 4,932,386 | 6/1990 | Vozumi et al. | 123/520 |
| 4,961,412 | 10/1990 | Furuyama | 123/520 |

FOREIGN PATENT DOCUMENTS

| | | |
|---|---|---|
| 57-52663 | 3/1982 | Japan . |
| 60-8458 | 1/1985 | Japan . |
| 61-98956 | 5/1986 | Japan . |
| 62-288342 | 12/1987 | Japan . |
| 63-50645 | 3/1988 | Japan . |

*Primary Examiner*—Tony M. Argenbright
*Assistant Examiner*—Robert E. Mates
*Attorney, Agent, or Firm*—Walter Ottesen

[57] ABSTRACT

In known methods for tank-ventilation adaptation, the last value of the charge factor is stored at the conclusion of the process and, when the process is restarted, is used directly as initial value of the charge factor for the tank-ventilation adaptation. In contrast, in the method according to the invention, the stored value is first multiplied by a reset factor and only the multiplication result is used as an initial value. The reset factor is a function of the fuel temperature and is a maximum of 1. The advantage of this method is that, when the process is restarted, good control results are obtained immediately, even when an internal combustion engine operated by means of the process is stopped with a high content of fuel vapor in the tank-venting gas and is restarted with a low content.

8 Claims, 2 Drawing Sheets

PROCESS AND DEVICE FOR TANK-VENTILATION ADAPTATION IN LAMBDA CONTROL

FIELD OF THE INVENTION

The invention relates to a method for tank-ventilation adaptation in the lambda control of the air/fuel mixture to be supplied to an internal combustion engine, in which a charge factor for the tank-venting gas is determined and at the conclusion of the method, the last value of the charge factor is stored. The invention further relates to an apparatus for carrying out such a method.

BACKGROUND OF THE INVENTION

A method and an apparatus according to the state of the art are now explained by reference to FIG. 1. The method is carried out on an engine 10 which has an injection arrangement 11 in its suction channel and a lambda probe 12 in its exhaust-gas channel. A signal TI, which is a measure of the injection time, is fed to the injection arrangement 11. This signal TI is formed from a provisional injection-time signal TIV (n, L) by logical combination with various correcting variables. As a rule, the provisional value for the injection time is read out from a characteristic field in which such values are stored as a function of values of the engine speed n and a load-dependent variable L. The logical combination takes place in a logic routine 13, in which the various correcting variables act on the particular values present by multiplication, addition or subtraction, depending on the type of variable.

The signal from the lambda probe 12 is fed as a lambda actual value to a subtraction step 14 and there it is subtracted from a lambda desired value. The control deviation thus formed is processed in a control unit 15, thereby producing as a regulating value a control factor FR. This control factor FR, on the one hand, is fed directly to the logic routine 13 and, on the other hand, serves for adaptation purposes. Via a change-over switch 16 which is shown as hardware in FIG. 1, but in practice is realized in software form, the control factor FR is alternately fed first to a mixture adaptation routine 17 for a period of time of, for example, 60 seconds and then to a charge-factor adaptation routine 18 for 90 seconds. The mixture adaptation routine 17 forms various correction values, for example those for compensating for injection-time errors caused by leakage air, by changes of air pressure or by changes in the performance of the injection arrangement 11.

The charge factor FTEAD adapted in the charge-factor adaptation routine 17 does not directly form a value usable in the logic routine 13, but is multiplied by a gas-volume value GV in a multiplication step 19. The multiplication value FTEA serves in the logic routine 13 as a value to be subtracted. The gas-volume value GV is read out from a characteristic field 20 as a function of values of the engine speed n and of the throttle flap angle DK.

Adaptation methods in lambda-control systems take place relatively slowly. Attempts are therefore made to store adapted values when the controlled internal combustion engine stops, so that they are available immediately at the next restart and the lengthy adaptation process does not have to be executed from the outset again. In this connection, when the internal combustion engine is switched off, the last value of the charge factor FTEAD is stored in a non-volatile memory (NV-RAM) 21. The stored value FTEADS is read out at the restart of the engine and is fed to the charge-factor adaptation routine 17 as an initial value for adaptation.

In practice, it repeatedly happens that a vehicle engine is switched off in the hot state in warm weather and a restart is effected again only with the engine cold and sometimes in considerably colder weather than before. When the engine is hot in warm weather, the charge factor FTEAD is approximately at the value 1, that is almost the entire tank-venting gas is fuel gas. In contrast, when the engine is cold in cold weather, the charge factor FTEAD corresponds essentially to the value 0, that is the tank-venting gas is almost exclusively zero, that is it contains scarcely any fuel gas. If the charge factor has first been adapted to the value 1 and, when the engine is restarted, this value is then used as a new initial value for the adaptation, even though the value 0 would actually be appropriate, the internal combustion engine initially receives far too little fuel before the control 15 provides sufficient compensation. Because of this, there is the possibility that, at the first transition to tank-ventilation adaptation, the engine will die or then run very roughly.

SUMMARY OF THE INVENTION

The object of the invention is to provide a method for tank-ventilation adaptation, which, even when a lambda-controlled internal combustion engine is restarted, leads quickly to a good control result. Another object of the invention is to provide a device for carrying out such a method.

The method according to the invention is characterized in that, when the controlled internal combustion engine is restarted, that is, when the method is restarted, the stored value of the charge factor is no longer adopted to its full extent. Instead, the charge factor is multiplied by a reset factor $<1$ and the value thus obtained is used as an initial value of the charge factor for the tank-ventilation adaptation. The reset factor is the greater, the higher the fuel temperature. It has proved advantageous in tests to set the charge factor to 0 below a minimum temperature and, on the other hand, to limit it in the upward direction to a maximum value $<1$.

For carrying out the method according to the invention, a device according to the invention has, in particular, a means which, when the device is activated, outputs a value for a reset factor $<1$ as a function of the fuel temperature. Moreover, the device possesses a means for multiplying the output value by the reset factor.

BRIEF DESCRIPTION OF THE DRAWINGS

The invention is explained in detail below by means of exemplary embodiments illustrated by figures. Of these.

DESCRIPTION OF THE PREFERRED EMBODIMENTS OF THE INVENTION

Figure 1:
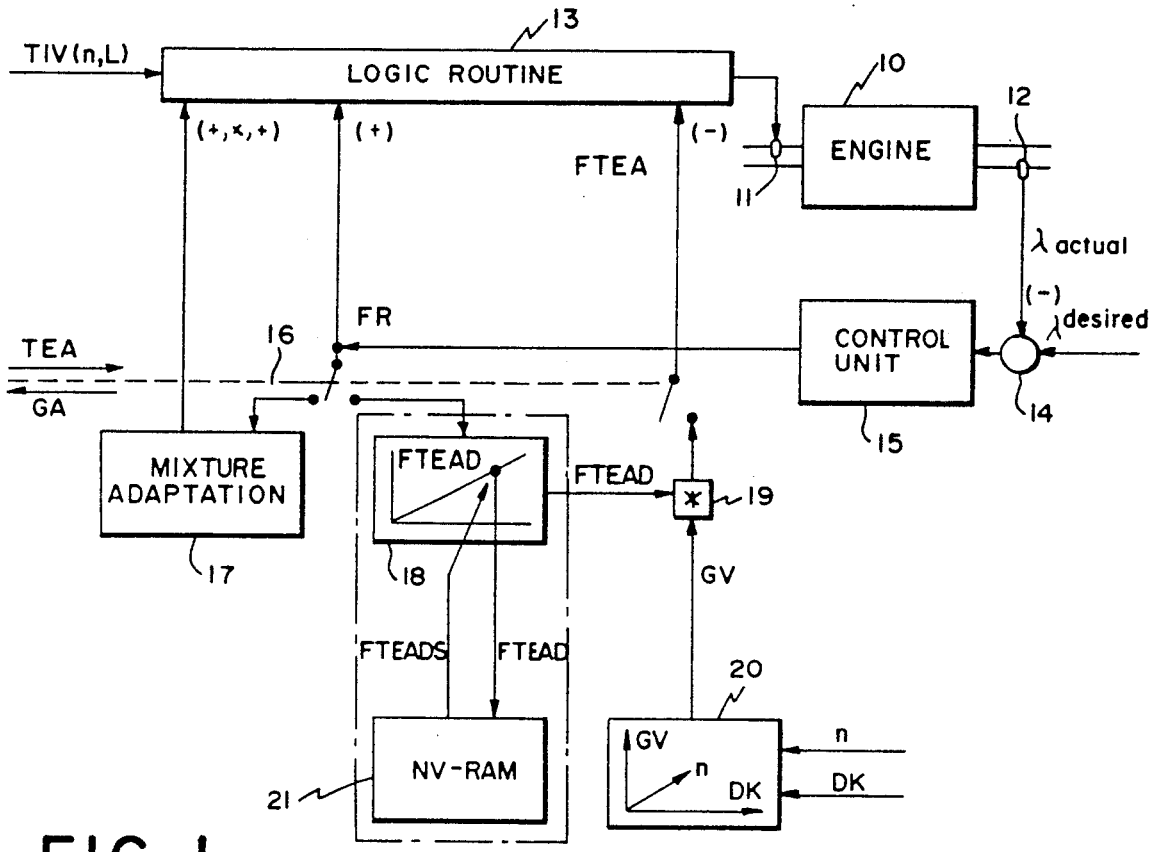
FIG. 1 PRIOR ART
FIG. 1 shows a method, represented as a block diagram, for tank-ventilation adaptation according to the state of the art, as explained above, wherein that part of the method modified by the invention is enclosed by dot-and-dash lines.
Figure 2:
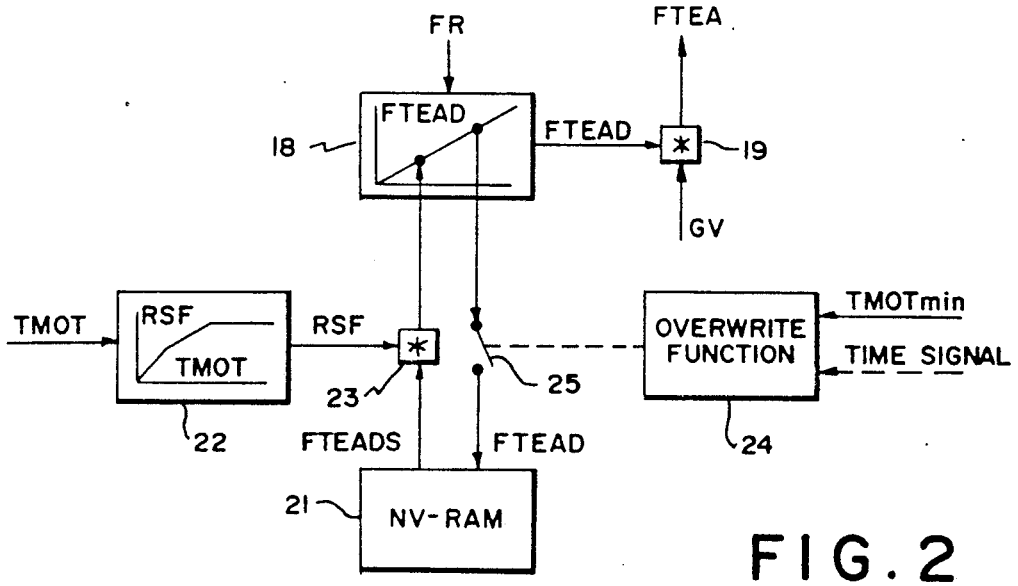
FIG. 2 shows a block diagram corresponding to the method part according to FIG. 1 represented by dot-and-dash lines, but as an embodiment according to the invention.

FIG. 2 is to be taken as part of the total method for tank-ventilation adaptation according to FIG. 1. In particular, the method part according to the state of the art bordered by dot-and-dash lines in FIG. 1 is replaced by the method part according to the invention illustrated in FIG. 2. This is that part by means of which the adapted tank-ventilation factor FTEAD is stored in the non-volatile memory 21 when the method is deactivated and is read out of the memory again when the method is activated.

Whereas the method part according to FIG. 1 enclosed by dot-and-dash lines possesses only the charge-factor adaptation routine 18 and the non-volatile memory 21, the corresponding method part according to the invention, as shown in FIG. 2, additionally has a characteristic evaluation 22 and a reset multiplication step 23. Advantageously, but not necessarily, there is also an overwrite function 24.

It will at first be assumed that the overwrite function 24 is missing and that the charge-factor value FTEAD last present at the deactivation of the method is entered in the non-volatile memory 21 in the conventional way. When the tank-ventilation adaptation method is restarted, the stored value FTEADS is not used directly as an initial value FTEAD for the newly begun charge-factor adaptation, but first there is a multiplication by a reset factor RSF $<1$ in the reset multiplication step 23. The particular reset-factor value RSF to be used is determined by the characteristic evaluation 22 as a function of the engine temperature TMOT.

Figure 3:
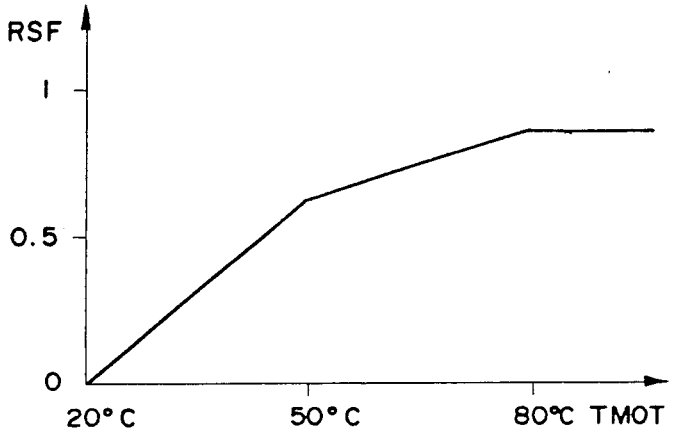
FIG. 3 shows a diagram explaining the relationship between a reset factor and the engine temperature; and, FIG. 4 shows a flowchart to explain a method for tank-ventilation adaptation.

FIG. 3 shows the relationship between the reset factor RSF and the engine temperature TMOT, as determined on a middle-class vehicle. If there are changes in the internal combustion engine or in the tank-ventilation design compared to the test system, then deviations will occur for the particular most purposeful relationship. According to the relationship shown, below 20° C. the reset factor RSF permanently assumes the value 0 . From 20° C. to 50° C., the reset factor rises linearly from 0 to approximately 0.6. Up to 80° C., it once again rises linearly at a somewhat smaller gradient up to approximately the value 0.8, then maintaining this value even at still higher engine temperatures. The tests conducted have shown that the actual charge factor is related to the engine temperature approximately to the extent shown. It was found in a wide variety of systems that there is a reproducible relationship between charge factor and engine temperature. This makes it possible, when the engine temperature and the charge factor are known, at the deactivation of the adaptation process to determine approximately that charge factor which should be applicable at a specific engine temperature when the process is restarted. It has emerged that it is not absolutely necessary, in practice, to store the engine temperature when the process is deactivated, this being explained in detail further below. For satisfactory control results, it is sufficient to determine the reset factor solely on the basis of the engine temperature at the restart.

Figure 4:
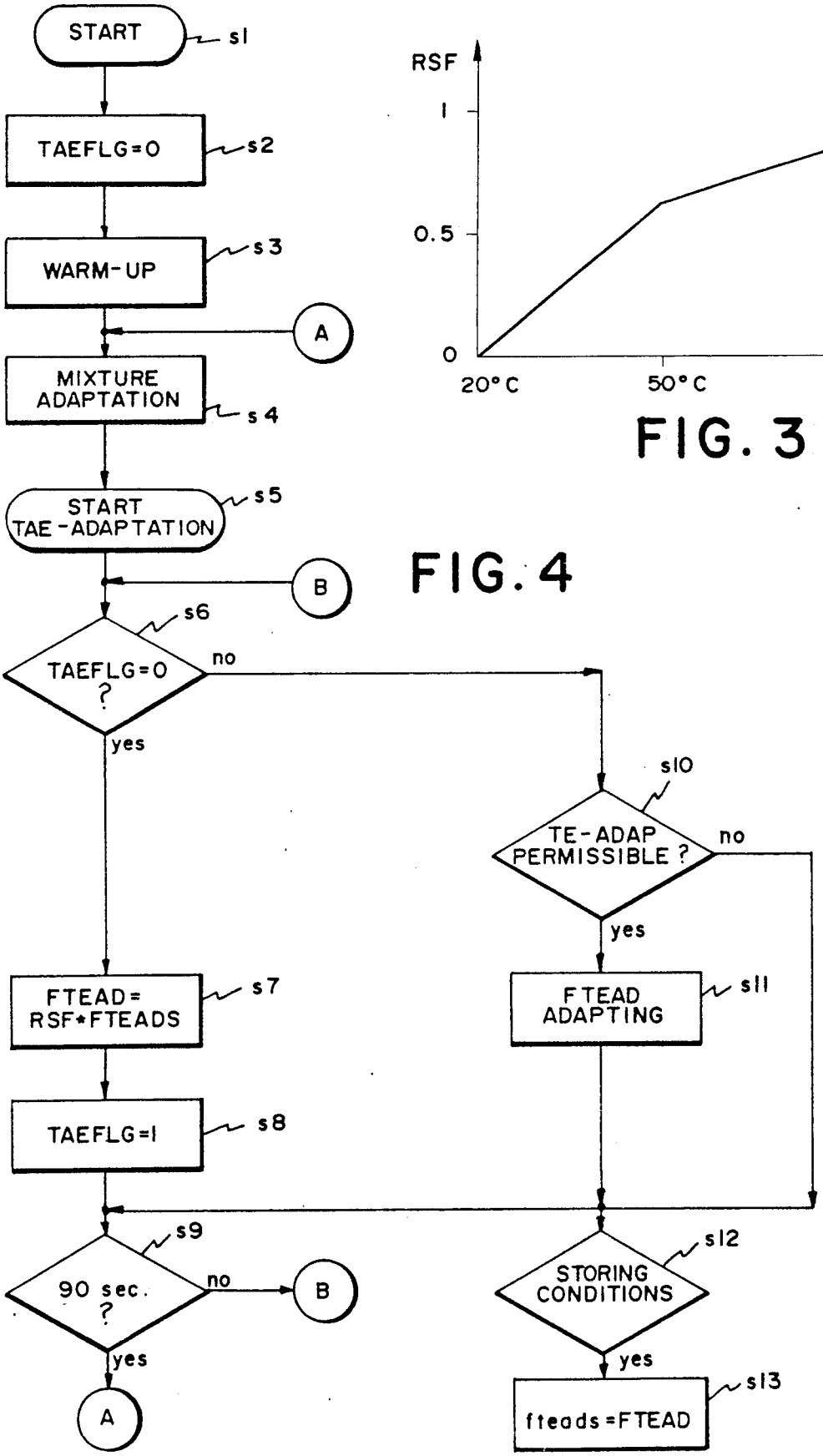

A survey of an entire lambda-control process is now given with reference to FIG. 4 with the tank-ventilation process being shown in detail.

In step s1 according to FIG. 4, a lambda-control process is started, for example when starting a motor vehicle. In a step s2, a tank-ventilation flag TAEFLG is set to 0 for the reasons explained further below. Step s3 symbolizes a hot-running subprogram. In this step, for example, a check is made as to whether the internal combustion engine is running at all and whether the lambda probe has already reached its operating temperature. If this is the case, that is if the actual lambda control can begin, the latter can be carried out continuously, this not being illustrated in detail in FIG. 4. Rather, in FIG. 4, after the step s3 adaptation processes are illustrated. In a step s4, there first follows a subprogram for mixture adaptation. This mixture-adaptation subprogram is limited in time, for example to 60 seconds. This is then followed, in a step s5, by the start of a subprogram for tank-ventilation adaptation.

In this subprogram for tank-ventilation adaptation, a check is first made in a step s6, as to whether the tank-ventilation flag TAEFLG is set to 0. If this is so, that is, if tank-ventilation adaptation occurs for the first time after the restart of the process, the initial value FTEAD for the charge factor is formed in a step s7 by multiplying the stored charge factor FTEADS by the reset factor RSF. Furthermore, the tank-ventilation flag TAEFLG is set in a step s8. Finally, in a step s9, a check is made as to whether the period of time of 90 seconds (according to the exemplary embodiment) for the tank-ventilation adaptation has already elapsed. Since, according to the process flow described, the tank-ventilation adaptation has only just begun, this question is answered in the negative, thus resulting in a return to step s6, that is to that step in which the state of the tank-ventilation flag is interrogated. Since the tank-ventilation flag was set in step s8, step s6 is now no longer departed from in the yest direction, but in the no direction. The result of this is that step s6 is followed by a step s10, in which a check is made as to whether the tank-ventilation adaptation is actually admissible or whether there is, for example, a transient operation present. If the latter is the case, the 90-second interrogation step s9 follows once again. However, if tan-ventilation adaptation is admissible, there follows the actual adaptation in a step s11, that is the charge value FTEAD is increased, reduced or left unchanged in dependence on the control-factor value FR just present. This takes place in the customary way, and therefore the adaptation mode is not discussed in detail here. Step s11 is followed once more by the 90-second interrogation step s9. It will now be assumed that the 90 seconds have elapsed. Step s9 is then followed by a new mixture-adaptation step s4.

The flowchart of FIG. 4 also shows two steps s12 and s13 which relate to the storage of the charge factor FTEAD in the non-volatile memory 21. To explain the meaning of these steps, it will first be assumed that storage takes place, without any further condition, directly after step s11, that is after the determination of a newly adapted charge factor. It will be further assumed that the charge factor FTEAD just has the value of 1 and that the engine temperature is 40° C., this corresponding approximately to a reset factor of 0.5. The process is now interrupted and then restarted immediately. This would result in a charge factor of $0.8 \times 0.5$, that is of 0.4. The process is interrupted immediately again, for example because the controlled internal combustion engine has stopped again after a short time, and is then restarted once more. If the last charge factor of 0.4 had now been stored, a new charge factor of $0.4 \times 0.5$, that is 0.2, would be obtained. After several restarts, the charge factor would therefore decrease from 0.8 to a very low value in spite of unchanged operating conditions.

This decrease is avoided by means of the step s12. In particular, in this step, a check is made as to whether a storage condition is satisfied, for example whether a minimum engine temperature is reached or whether, after the restart, the tank-ventilation adaptation phase has been run through completely at least once. The check of the storage conditions according to step s12 is also shown in FIG. 2, specifically by means of the overwrite function 24. This overwrite function 24 closes an overwrite switch 25, represented as hardware, but preferably produced in software form, when the condition for storage, that is for overwriting the old memory content, is satisfied. The closing of the overwrite switch 25 is triggered either by a signal TMOTMIN, indicating that a minimum engine temperature of, for example, 70° C. is reached, or triggering occurs as a result of a time signal which is transmitted at the end of the first complete run-through of the tank-ventilation adaptation phase, that is when the process according to FIG. 4 returns from step s9 to step s4 for the first time. Which condition is the most appropriate for the particular case depends on the system as a whole. If the times for the mixture-adaptation phase and the tank-ventilation adaptation phase are very short, it is more expedient to use a minimum engine temperature as the storage condition. However, if the values for the reset factor RSF are relatively low even for a high engine temperature, it is more expedient to select a time condition. The time condition can also be coupled to a fixed predetermined time, that is decoupled from the time periods of the adaptation phases.

It has proved favorable in any event to reset somewhat the value last stored for the charge factor when the process is restarted. This is achieved in that the reset factor is always determined as $<1$, even for high engine temperatures, and is preferably between 0.7 and 0.9 for the systems tested so far.

According to the foregoing explanation, the reset factor RSF is obtained by a characteristic evaluation 22. However, a device for tank-ventilation adaptation need not necessarily have a characteristic line, but there can also be a means for computing the reset factor from the engine temperature on the basis of a fixed pregiven mathematical relation. The output reset factor is linked by multiplication in a means for multiplying by the stored charge factor. The value thus obtained is transmitted to the means for adapting the charge factor as a new initial value for the tank-ventilation adaptation.

In the preferred exemplary embodiment described, the engine temperature is used as a variable dependent on the fuel temperature for determining the reset factor. This is because the engine temperature is a variable measured in any case for various purposes and is therefore normally available. However, a more accurate result is obtained when the fuel temperature itself is measured, since the evaporation of hydrocarbons and consequently the charging of the tank-venting gas with fuel vapor depend on this temperature. It is possible, in turn, for the fuel temperature measured at the first start of adaptation to be used as a variable for determining the charge factor. However, improved results are obtained when the fuel temperature has been measured and stored at the previous conclusion of the process and the fuel temperature measured at the next start of the process is divided by the stored temperature value, and when this variable, under certain circumstances also multiplied by a standardization factor, is used as an input variable for a characteristic evaluation to determine the charge factor. This takes into account the fact that the charge factor must be evermore reduced the higher the fuel temperature at the previous deactivation of the process is, compared to the fuel temperature present when the process is restarted.

We claim:

1. A method for tank-ventilation adaptation is the lambda control of the air/fuel mixture to be supplied to an internal combustion engine, the method comprising the steps of:

determining the charging factor for the tank-venting gas;

storing the last value as the charging factor at the end of the method;

multiplying the stored charge factor by a reset factor when the method is restarted, said reset factor having a maximum value of unity and being dependent on the value of a variable dependent on fuel temperature; and using the value obtained from the multiplication of said stored charge factor and said reset factor as an initial value of the charge factor for the tank-ventilation adaptation with the reset factor being the greater, the higher the value of the variable dependent on the fuel temperature is.

2. The method of claim 1, wherein the reset factor amounts at most to between 0.7 and 0.9.

3. The method of claim 1, wherein the reset factor is 0 below a lower temperature threshold.

4. The method of claim 1, wherein the charge factor is determined as a function of the engine temperature.

5. The method of claim 1, comprising the further steps of: obtaining the value of the variable dependent on the fuel temperature by measuring the fuel temperature at the conclusion of the method and storing said last-mentioned value; measuring the fuel temperature at the restart of the method; and, dividing this fuel temperature value by the stored fuel-temperature value.

6. The method of claim 1, wherein a new charge factor is stored at the end of the first tank-ventilation adaptation phase.

7. The method of claim 1, wherein a new charge factor is stored when a predetermined value of the variable dependent on the fuel temperature is reached.

8. Device for tank-ventilation adaptation in the lambda control of the air/fuel mixture to be supplied to an internal combustion engine, the device comprising:

adaptation means for adapting a charge factor;

a non-volatile memory for storing the last value of the charge factor when the device is deactivated;

means for outputting a value for a reset factor having a magnitude not exceeding unity when the device is activated, the value for said reset factor being dependent upon fuel temperature; and means for multiplying said last value of said charge factor by the reset factor and for transmitting the multiplication value to said adaptation means for adapting the charge factor as a new initial value for the tank-ventilation adaptation.

* * * * *

UNITED STATES PATENT AND TRADEMARK OFFICE

CERTIFICATE OF CORRECTION

PATENT NO. : 5,044,341

DATED : September 3, 1991

INVENTOR(S) : Henning Cordes, Jürgen Kurle and Martin Eberhard Pfau

It is certified that error appears in the above-identified patent and that said Letters Patent is hereby corrected as shown below:

Title page, item [19], delete "Henning et al" and substitute -- Cordes et al -- therefor.

On the title page, item [75]: delete "Cordes Henning" and substitute -- Henning Cordes -- therefor.

On the title page, item [75]: delete "Kurle Jürgen" and substitute -- Jürgen Kurle -- therefor.

On the title page, item [75]: delete "Pfau M. Eberhard" and substitute -- Martin Eberhard Pfau -- therefor.

In column 4, line 36: delete "yest" and substitute -- yes -- therefor.

In column 4, line 42: delete "tan-ventilation" and substitute -- tank-ventilation -- therefor.

UNITED STATES PATENT AND TRADEMARK OFFICE

CERTIFICATE OF CORRECTION

PATENT NO. : 5,044,341

DATED : September 3, 1991

INVENTOR(S) : Henning Cordes, Jürgen Kurle and Martin Eberhard Pfau

It is certified that error appears in the above-identified patent and that said Letters Patent is hereby corrected as shown below:

In column 6, line 13: delete "is" and substitute -- in -- therefor.

In column 6, line 25, after "and", insert -- , --.

In column 6, line 61, after "and", insert -- , --.

Signed and Sealed this

Eleventh Day of May, 1993

*Attest:*

Michael K. Kirk

MICHAEL K. KIRK

*Attesting Officer*

*Acting Commissioner of Patents and Trademarks*